United States Patent [19]

Anderson

[11] 4,076,994

[45] Feb. 28, 1978

[54] FLAT DISPLAY DEVICE WITH BEAM GUIDE

[75] Inventor: Charles Hammond Anderson, Rocky Hill, N.J.

[73] Assignee: RCA Corporation, New York, N.Y.

[21] Appl. No.: 675,639

[22] Filed: Apr. 9, 1976

[51] Int. Cl.[2] ..... H01J 29/70; H01J 31/00; H01J 31/10

[52] U.S. Cl. ..... 313/422; 315/366

[58] Field of Search ..... 313/423, 432, 422, 434; 315/3 (U.S. only)

[56] References Cited

U.S. PATENT DOCUMENTS

| | | | |
|---|---|---|---|
| 2,858,464 | 10/1958 | Roberts | 313/422 X |
| 3,315,117 | 4/1967 | Udelson | 315/3 |
| 3,504,222 | 3/1970 | Fukushima | 315/3 |
| 3,849,695 | 11/1974 | Piazza et al. | 315/3 |

*Primary Examiner*—Robert Segal

*Attorney, Agent, or Firm*—Glenn H. Bruestle; Donald S. Cohen

[57] ABSTRACT

An evacuated envelope has a rectangular display section and a gun section at one side of the display section. The display section includes rectangular front and back walls in closely spaced, substantially parallel relation, and a plurality of spaced, substantially parallel support walls between the front and back walls forming a plurality of parallel channels. The gun section extends across one end of the channels and includes gun structure which will selectively direct one or more electron beams along each of the channels. In each of the channels is a beam guide which confines the electrons of the beam but permits selective deflection of the electron beam out of the guide toward a phosphor screen on the inner surface of the front wall. The beam guide includes spaced, parallel conductors on the inner surface of the back wall extending transversely across the channels and a plurality of electrodes on the surfaces of walls which extend from the back wall toward the front wall. The electrodes on each surface of the walls are arranged in spaced, parallel rows extending longitudinally along the channel. Electrical potentials are applied to the electrodes which create electrostatic fields between the electrodes in the two rows as well as between the electrodes on adjacent walls. These electrostatic fields create forces which confine the electrons in a beam which flows longitudinally along the channel. Potentials applied to the electrodes on the back wall cause the beam to be deflected out of the beam guide toward the front wall.

25 Claims, 6 Drawing Figures

FLAT DISPLAY DEVICE WITH BEAM GUIDE

BACKGROUND OF THE INVENTION

The present invention relates to a flat image display device including apparatus for scanning electron beams over the image screen thereof, and particularly to a structure for confining and guiding the beams and for selectiely deflecting the beams toward the image screen.

It has long been a desire to reduce the depth dimension of a picture tube to provide a substantially flat display device. One structure which has been proposed includes a thin boxlike envelope with one of the large sides thereof constituting a faceplate on which a phosphor screen is disposed. An electron gun directs electrons across the tube in a path substantially parallel to the screen. Deflection elements are provided to selectively deflect the electrons onto successive points of the screen to achieve the desired scanning thereof. A tube of this type is shown in U.S. Pat. No. 2,928,014 to W. R. Aiken et al, issued Mar. 8, 1960 entitled "Electronic Device Cathode Ray Tubes".

In using this technique a problem has arisen in making flat display devices having large area screens, such as screens which are about 75 centimeters by 100 centimeters. For large size devices some type of internal support structure is required to prevent the evacuated tube from collapsing. A device having such internal support is shown in U.S. Pat. No. 2,858,464 to W. L. Roberts, issued Oct. 28, 1958, entitled "Cathode Ray Tube". In a tube having internal structure, the confinement and guiding of the electron beam is more critical to prevent the supporting structure from interfering with the electron beam. As a beam of electrons moves away from its source, the electrons tend to spread out, making the size of the beam larger. If the electrons spread out enough to contact the supporting structure, parts of the tube become charged and cause malfunctioning of the tube.

As described in the copendng application of T. O. Stanley, Ser. No. 607,492, filed Aug. 25, 1975, entitled "Flat Electron Beam Addressed Device" the confinement of the electron beam can be accomplished by means of beam guides which apply electrostatic forces to the electrons of the beam to confine the electrons in a relatively small beam as the beam travels along a path across the envelope. The beam guide also provides for deflection of the beam out of its path toward the phosphor screen at selective points along the beam path. For ease of construction of such a flat display device, it is desirable that the beam guides be of a relatively simple construction, i.e., the guide be made up of a minimum number of parts which can be easily assembled, yet still perform its desired function.

SUMMARY OF THE INVENTION

In an electron display device of the type referred to above, the guide means includes a plurality of conductors adjacent to the back wall of the envelope with the conductors being spaced along and extending transversely across the beam path. A plurality of electrodes are along opposite sides of the beam path between and spaced from the front and back walls and along planes extending between the front and back walls. The electrodes are adapted to provide an electrostatic field around the beam path which will confine the electrons in the beam as the electrons move along the beam path.

DETAILED DESCRIPTION OF THE INVENTION

Figure 1:
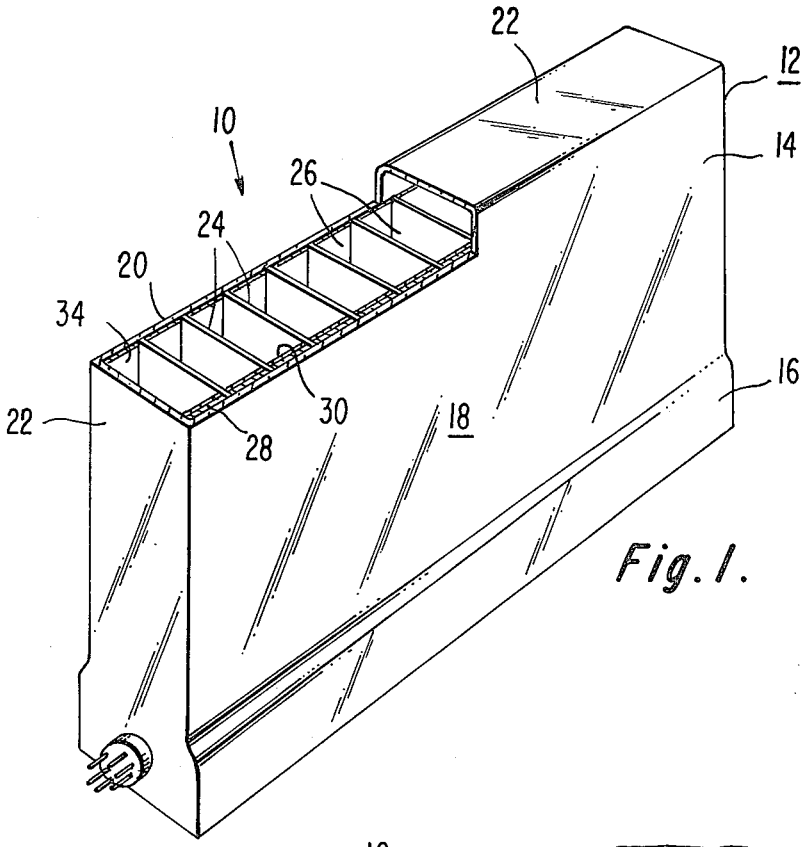
FIG. 1 is a perspective view, partially cut away, of a flat display device into which the present invention can be incorporated.

Referring to FIG. 1, one form of a flat display device of the present invention is generally designated as 10. The display device 10 comprises an evacuated envelope 12, typically of glass, having a display section 14 and an electron gun section 16. The display section 14 includes a rectangular front wall 18 which is the viewing screen, and a rectangular back wall 20 in spaced, parallel relation with the front wall 18. The front wall 18 and back wall 20 are connected by side walls 22. The front wall 18 and back wall 20 are dimensioned to provide the size of the viewing screen desired, e.g., 75 by 100 centimeters, and are spaced apart about 2.5 to 7.5 centimeters.

A plurality of spaced, parallel support walls 24 are secured between the front wall 18 and the back wall 20 and extend from the gun section 16 to the opposite side wall 22. The support walls 24 provide the desired internal support for the evacuated envelope 12 against external atmospheric pressure and divide the display section 14 into a plurality of channels 26. On the inner surface of the front wall 18 is a phosphor screen 28. The phosphor screen 28 may be of any well known type presently being used in cathode ray tubes, e.g., black and white or color television display tubes. A metal film electrode 30 is provided on the phosphor screen 28.

The gun section 16 is an extension of the display section 14 and extends along one set of adjacent ends of the channels 26. The gun section may be of any shape suitable to enclose the particular gun structure contained therein. The electron gun structure contained in the gun section 16 may be of any well known construction suitable for selectively directing beams of electrons along each of the channels 26. For example, the gun structure may comprise a plurality of individual guns mounted at the ends of the channels 26 for directing separate beams of electrons along the channels. Alternatively, the gun structure may include a line cathode extending along the gun section 16 across the ends of the channels 26 and adapted to selectively direct individual beams of electrons along the channels. A gun structure of this type is described in U.S. Pat. No. 2,858,464 to W. L. Roberts, issued Oct. 28, 1958, entitled "Cathode Ray Tube".

In each of the channels 26 is a focusing guide for maintaining focus of an electron beam as it travels a path along the channel. The guide also includes means for deflecting the beam toward the phosphor screen 28 at various points along the length of the channel 26.

Figure 2:
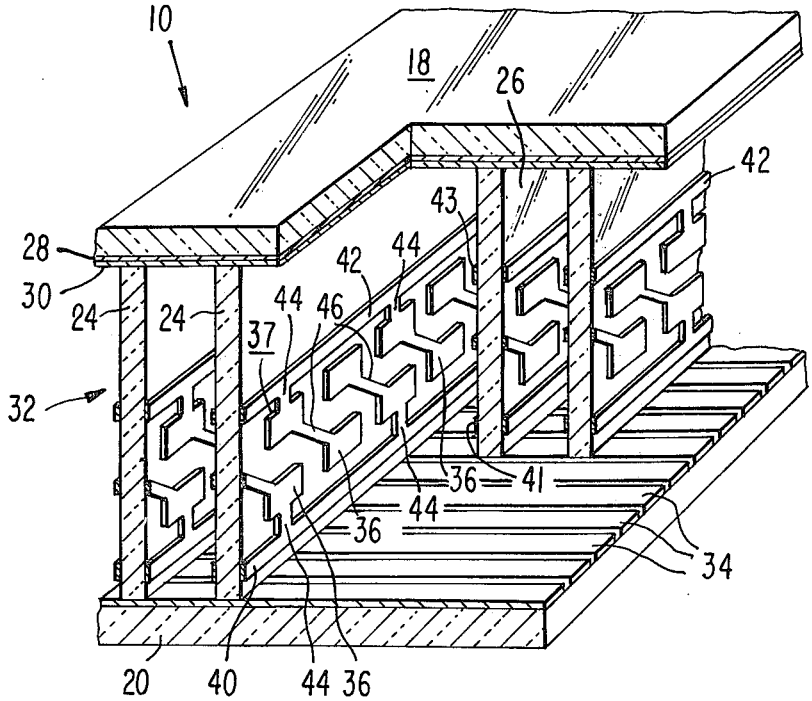
FIG. 2 is a perspective view, partially broken away, of a portion of the display device illustrated in FIG. 1 showing a form of the beam guides of the present invention.

Referring to FIG. 2, one form of a beam guide of the present invention in a channel 26 is generally designated as 32. The beam guide 32 includes a plurality of extraction conductors 34 on the inner surface of the back wall 20. The extraction conductors 34 extend transversely across the channels 26 and are in spaced, parallel relation along the entire length of the channels 26. As shown, the extraction conductors 34 are strips of an electrically conductive material, such as a metal, coated on the inner surface of the back wall 20.

In each channel are a plurality of focusing electrodes of an electrically conductive material, such as a metal, disposed in planes perpendicular to the front wall 18 and back wall 20. As shown, the focusing electrodes are metal films coated on the opposed surfaces of the support walls 24. The focusing electrodes are arranged in sets of four electrodes 36, 37, 38 and 39 with the electrodes in each set being equidistant from the gun section 16. In each set of the electrodes, two of the electrodes 36 and 37 are at one side of the channel 24 and are in alignment along a line perpendicular to the front and back walls 18 and 12. The other two electrodes 38 and 39 are at the other side of the channel 24 and are in alignment along a line perpendicular to the front and back walls 18 and 20. The electrodes 36 and 38 of all of the sets are in aligned rows longitudinally of the channel adjacent the back wall 18 with each electrode 36 being directly opposite the electrode 38 of its set. The electrodes 37 and 39 are also in aligned rows longitudinally of the channel between the electrodes 36 and 38 respectively and the front wall 18. Each electrode 37 is directly opposite the electrode 39 of its respective set.

Conductor strips 40 and 41 extend longitudinally along each channel 24 between the back wall 20 and the electrodes 36 and 38 respectively. Conductor strips 42 and 43 extend longitudinally along the channel 24 between the front wall 18 and the electrodes 37 and 39 respectively, adjacent to the electrodes 37 and 39. The electrodes 36, 37, 38 and 39 of alternate sets are electrically connected to their adjacent conductor strips 40, 41, 42 and 43 respectively, by connecting strips 44. Each of the electrodes 36 which is electrically connected to the conductor strip 40 is electrically connected to the electrode 37 in the adjacent set of electrodes by a connecting strip 46. Each of the electrodes 37 which is connected to the conductor strip 42 is electrically connected to an electrode 36 in an adjacent set of conductors by a connecting strip 46. Likewise each of the electrodes 38 which is electrically connected to its adjacent conductor strip 41 is electrically connected to an electrode 39 of an adjacent set of electrodes by a connecting strip 46 and each of the electrodes 39 which is electrically connected to its adjacent conductor strip 42 is electrically connected to an electrode 38 in an adjacent set of electrodes by a connecting strip 46. Thus, the electrodes 36, 37, 38 and 39 which are not electrically connected to their adjacent conductor strips are electrically connected to a nonadjacent conductor strip. The conductor strips and the connecting strips are of a conducting material, such as a metal, and as shown, are coated on the surfaces of the support walls 24.

In the operation of the display device 10, a low negative potential, e.g., about −50 volts, is applied to each of the extraction conductors 34. A relatively low positive potential, e.g., about +150 volts. is applied to one of the conductor strips on each wall of the channel 26 and a higher positive potential, e.g., about +450 volts, is applied to the other conductor strip on each wall.

Figure 3:
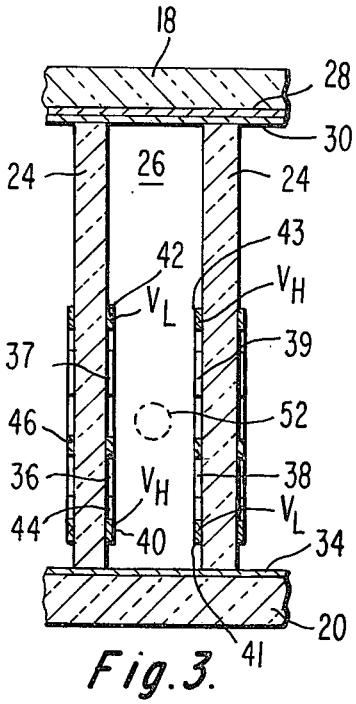
FIG. 3 is a transverse sectional view of the beam guide illustrated in FIG. 2.

As indicated in FIG. 3, on one wall of each channel 26, the high potential, $V_H$, is applied to the conductor strip 40 and the low potential, $V_L$, is applied to the conductor strip 42 whereas on the other wall of each channel the high potential, $V_H$, is applied to the conductor strip 43 and the low potential, $V_L$, is applied to the conductor strip 41. Thus, in each channel 26 the electrodes 36 and 37 which are connected to the conductor strip 40 are at a high potential, $V_H$, and the elecrodes 37 and 36, which are connected to the conductor strip 42, are at a low potential, $V_L$. The electrodes 38 and 39 which are connected to the conductor strip 41 are at a low potential, $V_L$, and the electrodes 39 and 37 which are connected to the conductor strip 43 are at a high potential, $V_H$. Thus, in each set of electrodes opposing electrodes are at opposite potentials, i.e, one high and the other low, and electrodes on the same support wall are at opposite potentials. In alternate sets of the electrodes the potentials are reversed.

The gun structure in the gun section generates electrons and directs a beam of the electrons into the guide 32 in each channel 26. The electron beam is directed along a line which extends longitudinally along the channel between the rows of electrodes. The electron beam is shown in phantom in FIG. 3 and is indicated as 52.

Figure 4A:
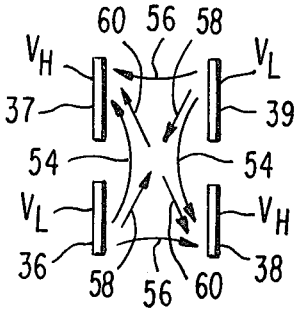
FIGS. 4*a* and 4*b* are schematic views showing the electrostatic fields at two positions along the beam guide and the forces created by the fields.
Figure 4B:
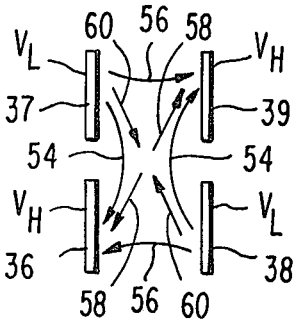

As shown in FIGS. 4*a* and 4*b*, the potential difference between the aligned electrodes 36 an 37 on one wall and the aligned electrodes 38 and 39 on the other wall of the channel 26 creates an electrostatic field which extends along the wall between the electrodes as indicated by the arrows 54. The potential difference between the opposed electrodes 36 and 38 and the opposed electrodes 37 and 39 on the opposite walls of the channel 26 creates an electrostatic field which extends across the channel between the opposed electrodes as indicated by the arrows 56. Thus, the electron beam 52 is surrounded by the electrostatic fields created between the electrodes. As shown in FIG. 4*a*, in the regions of the guide 32 between one set of the electrodes, the electrostatic fields create forces which extend inwardly toward the beam of electrons from the electrodes which are at the low potential as indicated by the arrows 58 and forces which are at the low potential as indicated by the arrows 58 and forces which extend outwardly from the electron beam toward the electrodes which are at the high potential as indicated by the arrows 60. Thus, in these regions the electron beam 52 is compressed radially inwardly along the force line 58 but spread radially outwardly along the force line 60. As shown in FIG. 4*b*, in the regions of the guide 32 between the next adjacent set of electrodes, the electrostatic fields extend in the direction opposite to that in the regions shown in FIG. 4*a* since the high and low potentials are reversed. Thus, the forces created by the electrostatic fields are also reversed, i.e., the force lines 60 which are outwardly in the previous region are radially inwardly in this region so as to compress the electron beam and the force lines 58 which are inwardly in the previous region are outwardly in this region so as to allow the electron beam to spread out. Thus, as the electron beam 52 flows longitudinally along the guide 32 the beam is alternately compressed inwardly from different directions. This periodic compression or periodic focusing confines the electrons in the beam 52 as the beam flows along the guide 32.

To extract the electron beam 52 from the guide 32 at a given point along the guide, the potential applied to the conductor 34 at that point is switched to a high negative potential, e.g., about −200 volts. This high negative potential applies a force to the beam 52 to cause the beam to be deflected away from the conductor and toward the front wall 18. The electron beam 52 will then be attracted to the phosphor screen 28 by a high positive potential, generally about +5 to +10 kilovolts, applied to the metal film 30 so that the electron beam will impinge on the phosphor screen.

In the operation of the display device 10, the conductor 34 closest to the side wall 22 directly opposite the gun section 16 is first switched to the high negative potential. Thus, all of the beams 46 in all of the channels 26 will be deflected at a point close to that side wall 22 to pass out of the guide 32 and impinge on the phosphor screen 38 to provide a line scan of the phosphor screen 28. The electrodes 34 are then switched to the high negative potential in sequence along the entire length of the channels so that the beams are extracted from the guides 32 at various points along the length of the guides to provide a line-by-line scan of the phosphor screen 28. By carrying out this switching at the proper speed and by modulating the various beams in the gun section 16 during each line scan, a visual display can be provided on the phosphor screen 28 which can be viewed through the front wall 18 of the envelope 12.

Figure 5:
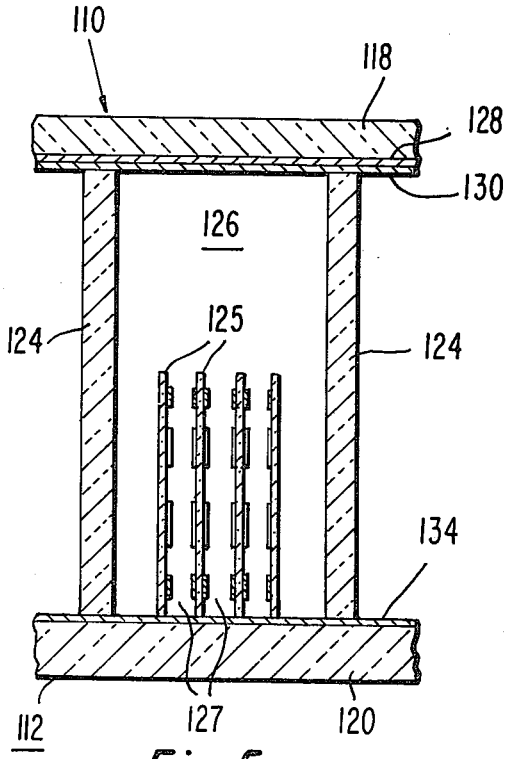
FIG. 5 is a transverse sectional view of a portion of a modification of the display device of the present invention.

Referring to FIG. 5, a modification of the display device of the present invention is generally designated as 110. The modified device 110 provides for a plurality of beam guides between each adjacent pair of support walls. The display device 110 comprises an evacuated envelope 112 of the same construction as the envelope 12 shown in FIG. 1. The envelope includes a front wall 118, a back wall 120 and spaced, parallel support walls 124 extending between the front and back walls. The support walls 124 form channels 126 therebetween. A phosphor screen 128 is on the inner surface of the front wall 118 and a metal film electrode 130 is on the phosphor screen 128. A plurality of extraction electrodes 134 of the same construction as the extraction electrodes 34 of the display device 10 shown in FIGS. 2 and 3 are on the inner surface of the back wall 120 and extend in spaced, parallel relation transversely across the channels 126.

A plurality of partition walls 125 are mounted in spaced, parallel relation on the inner surface of the back wall 120. The partition walls 125 extend the full length of the channel 126 parallel to the support walls 124. The partition walls 125 project from the back wall 120 toward the front wall 118 a distance less than the distance between the back and front walls. The partition walls 125 form electron beam guide passages 127 therebetween. In each of the guide passages 127 is a beam guide of the same construction as the beam guide 32 shown in FIGS. 2 and 3. Thus, each beam guide includes the rows of focusing electrodes on the opposing surfaces of the additional walls 125 which electrodes are arranged and electrically connected in the manner shown in FIGS. 2 and 3.

The display device 110 operates in the same manner as previously described with regard to the display device 10 except that in the display device 110 a separate beam of electrons is directed into each guide passage 127 between the partition walls 125. The electron beams are confined by the beam guides in the same manner as previously described and are deflected out of the guide passages 127 by switching the voltages applied to the extraction electrodes 134. Although the display device 110 is shown as having three beam guide passages 127 in each channel 126, there can be any desired number of the beam guide passages in each channel.

In the display devices of the present invention it is preferable to coat the surfaces of the walls on which the beam guide electrodes and conductors are provided, i.e., either the support walls 24 of the display device 10 or the partition walls 125 of the display device 110, with a material having a high resistivity, i.e., $10^9$–$10^{11}$ ohms/square. The high resistivity material should extend around and between the electrodes and conductors of the beam guide. The high resistivity coating would serve to carry away any charge which lands on the wall so as to prevent any adverse interference with the operation of the beam guide.

I claim:

1. In a display device which includes an evacuated envelope having mutually spaced, substantially parallel front and back walls, a phosphor screen adjacent to and substantially coextensive with the inner surface of said front wall, means in said envelope for generating and directing electrons in a path between and substantially parallel to said front and back walls, and guide means along said path for confining the electrons in a beam and deflecting the beam toward said phosphor screen at selected points along said path, the improvement comprising said guide means including a plurality of conductors adjacent to said back wall, said conductors being spaced along and extending transversely across said beam path, and a plurality of electrodes along opposite sides of the beam path between and spaced from the front and back walls and disposed in planes extending between and substantially perpendicular to the front and back walls, said electrodes being adapted to provide an electrostatic field around the beam path which will confine the electrons in the beam as the electrons flow along the beam path.

2. A display device in accordance with claim 1 wherein the electrodes on each side of the beam path are arranged in a pair of parallel rows extending longitudinally along the beam path with each row including a plurality of spaced electrodes, one of said rows being adjacent but spaced from the back wall and the other row being between the one row and the front wall but adjacent the one row.

3. A display device in accordance with claim 2 wherein each of the electrodes in each row is in alignment with a separate electrode in the adjacent row along lines substantially perpendicular to the front and back walls.

4. A display device in accordance with claim 3 in which in each row of the electrodes alternate ones of the electrodes are electrically connected together.

5. A display device in accordance with claim 4 in which a separate conductor extends along each row of electrodes and is electrically connected to alternate ones of the electrodes.

6. A display device in accordance with claim 5 in which aligned electrodes are electrically connected to the conductors.

7. A display device in accordance with claim 6 in which each of the electrodes in each row which is not connected to its adjacent conductor is electrically connected to an adjacent electrode in the other row which is electrically connected to its adjacent conductor.

8. A display device in accordance with claim 1 including means for generating and directing electrons along a plurality of spaced parallel paths between and substantially parallel to said front and back walls, and a guide means along each of said paths.

9. A display device in accordance with claim 8 wherein the electrodes on each side of each of the beam paths are arranged in a pair of parallel rows extending longitudinally along the beam path with each row including a plurality of spaced electrodes, one of said rows being adjacent but spaced from the back wall and the other row being between the one row and the front wall but adjacent the one wall.

10. A display device in accordance with claim 9 wherein each of the electrodes in each row is in alignment with a separate electrode in the adjacent row along lines substantially perpendicular to the front and back walls.

11. A display device in accordance with claim 10 in which in each row of the electrodes alternate ones of the electrodes are electrically connected together.

12. A display device in accordance with claim 11 in which a separate conductor extends along each row of electrodes and is electrically connected to alternate ones of the electrodes.

13. A display device in accordance with claim 12 in which aligned elctrodes are electrically connected to the conductors.

14. A display device in accordance with claim 13 in which each of the electrodes in each row which is not connected to its adjacent conductor is electrically connected to an adjacent electrode in the other row which is electrically connected to its adjacent conductor.

15. A display device in accordance with claim 14 in which each of the electrodes faces a corresponding electrode on the opposite side of its respective beam path.

16. In a display device which includes an evacuated envelope having closely spaced, substantially parallel front and back walls and a plurality of spaced, substantially parallel support walls extending substantially perpendicularly between said front and back walls and forming a plurality of channels extending across said front and back walls, a phosphor screen along the inner surface of said front wall in each of the channels, means at one end of said channels for generating and directing electrons along each of said channels, and at least one guide means along each of said channels for confining the electrons in at least one beam which travels in a path longitudinally along the channel but permitting the beam to be deflected out of the guide means toward the phosphor screen at selected points along the path, the improvement comprising said guide means including a plurality of spaced conductors adjacent to the inner surface of the back wall and extending transversely across the channels, and a plurality of electrodes along each of said channels and spaced from the front and back walls, said electrodes being in planes extending between and substantially perpendicular to said front and back walls and being positioned on opposite sides of the beam path, said electrodes being adapted to provide an electrostatic field around the beam path which will confine the electrons in the beam as the electrons flow along the channel.

17. A display device in accordance with claim 16 in which the electrodes on each side of each of the beam paths are arranged in a pair of parallel rows extending longitudinally along the respective channel with each row including a plurality of spaced electrodes, one of the rows being adjacent but spaced from the back wall and the other row being between the one row and the front wall but adjacent the one row.

18. A display device in accordance with claim 17 wherein each of the electrodes in each row is in alignment with a separate electrode in the adjacent row along lines substantially perpendicular to the front and back walls.

19. A display device in accordance with claim 18 in which in each row of the electrodes alternate ones of the electrodes are electrically connected together.

20. A display device in accordance with claim 19 in which a separate conductor extends longitudinally along the channels along each row of electrodes and is electrically connected to alternate ones of the electrodes.

21. A display device in accorrdance with claim 20 in which aligned electrodes are electrically connected to the conductors.

22. A display device in accordance with claim 21 in which each of the electrodes in each row which is not connected to its adjacent conductor is electrically connected to an adjacent electrode in the other row which is electrically connected to its adjacent conductor.

23. A display device in accordance with claim 22 in which each of the electrodes faces a corresponding electrode on the opposite side of its respective beam path.

24. A display device in accordance with claim 23 in which the electrodes and conductors are conductive films on the walls of the channels.

25. A display device in accordance with claim 23 including additional walls in each channel extending from the back wall toward the front wall in spaced parallel relation, said additional walls forming therebetween at least one passage along which the beam of electrons travels, and the electrodes and conductors are conductive films on the opposing surfaces of said additional walls.

* * * * *